US005136946A

United States Patent [19]

Becker

[11] Patent Number: 5,136,946

[45] Date of Patent: Aug. 11, 1992

[54] CLAMPING DEVICE FOR AN AXIALLY DISPLACEABLE ADJUSTING MEMBER FOR CHANGING-OVER A GRIPPER ON A GRIPPER CYLINDER OF A SHEET-FED ROTARY PRINTING MACHINE

[75] Inventor: Willi Becker, Bammental, Fed. Rep. of Germany

[73] Assignee: Heidelberger Druckmaschinen AG, Heidelberg, Fed. Rep. of Germany

[21] Appl. No.: 654,748

[22] Filed: Feb. 13, 1991

[30] Foreign Application Priority Data

Feb. 13, 1990 [DE] Fed. Rep. of Germany ..... 4004352

[51] Int. Cl.[5] ..... B41F 21/10

[52] U.S. Cl. ..... 101/410; 101/247; 101/230; 74/156; 74/519; 271/902; 271/225

[58] Field of Search ..... 101/183, 230, 231, 247, 101/248, 407.1, 408, 409, 410, 411, 412; 74/25, 38, 156, 519, 439; 271/82, 184, 902, 225

[56] References Cited

U.S. PATENT DOCUMENTS

| | | | |
|---|---|---|---|
| 883,769 | 4/1908 | Wise | 74/519 |
| 4,147,105 | 4/1979 | Becker | 74/439 |
| 4,457,231 | 7/1984 | Kawaguchi | 101/230 |
| 4,664,032 | 5/1987 | Abendroth | 101/230 |
| 4,716,828 | 1/1988 | Hartung | 101/415.1 |
| 4,787,261 | 11/1988 | Becker | 101/230 |
| 4,833,989 | 5/1989 | Wieland | 101/410 |
| 5,031,531 | 7/1991 | Becker | 101/230 |

FOREIGN PATENT DOCUMENTS

| | | | |
|---|---|---|---|
| 6695086 | 9/1987 | Australia . | |
| 559297 | 6/1958 | Canada | 101/415.1 |
| 2321427 | 4/1973 | Fed. Rep. of Germany | 101/409 |
| 3004273 | 8/1981 | Fed. Rep. of Germany | 101/409 |
| 3814831 | 10/1989 | Fed. Rep. of Germany . | |

*Primary Examiner*—Edgar S. Burr
*Assistant Examiner*—Eric P. Raciti
*Attorney, Agent, or Firm*—Herbert L. Lerner; Laurence A. Greenberg

[57] ABSTRACT

In a sheet-fed rotary printing machine having a sheet-turning device including a gripper cylinder and an adjusting member extending in axial direction of and axially displaceable on the gripper cylinder for changing-over a gripper on the gripping cylinder, a clamping device for the adjusting member, includes a preloaded spring, clamping members disposed on both sides of and in vicinity of axial ends of the adjusting member and being displaceable radially to the gripper cylinder, and a pressure bar axially movably guided in the gripper cylinder and biased by a reaction force of the spring in a clamping direction for firmly clamping the clamping members via respective intermediate elements radially towards the gripper cylinder.

5 Claims, 7 Drawing Sheets

CLAMPING DEVICE FOR AN AXIALLY DISPLACEABLE ADJUSTING MEMBER FOR CHANGING-OVER A GRIPPER ON A GRIPPER CYLINDER OF A SHEET-FED ROTARY PRINTING MACHINE

The invention relates to a clamping device for an axially displaceable adjusting member for changing-over a gripper cylinder of a sheet-turning device in a sheet-fed rotary printing machine.

Such a clamping device has become known heretofore from German Patent 38 14 831 or its corresponding U.S. Pat. No. 5,031,531. In this known arrangement, a preloaded spring, permanently exerting its reaction force on the clamping device while in the operating state thereof, is a component of a device for adjusting the rotational position or setting of the gripper cylinder of a turning device wherein a fixed gearwheel and an adjustable gearwheel coaxial therewith are clamped together. The spring that effects such a clamping is braced at one end thereof against a radial flange on a pressure bar or rod, the pressure bar being movably guided in the gripper cylinder axially parallel to the longitudinal axis of the gripper cylinder and, with an inner end thereof, acts upon a counter-bearing on a first arm of a double or double-armed lever, the double lever being swivellable in the gripper cylinder about a transverse shaft and including, on a second arm thereof, a support for clamping members which are movably guided in the adjusting member, directly or through the intermediary of further intermediate members, radially with respect to the longitudinal axis of the gripper cylinder, so that the reaction force of the spring effecting the clamping of the gearwheels acts upon the clamping members via the pressure bar and the pressure lever and effects the clamping of the adjusting member on the gripper cylinder in a manner corresponding to the clamping between the adjustable gearwheel and the fixed gearwheel. An adjusting element integrated into an electrical safety system ensures a reduction in the spring tension, so that the clamping of the gearwheels and thus, simultaneously, of the adjusting member to the gripper cylinder is released and the changeover operation is enabled, for example, by turning an eccentric mechanism by means of a socket wrench or the like either directly on the gripper cylinder or through the intermediary of an actuating shaft extending out of the gripper cylinder on the drive side of the printing machine. When the clamping of the gearwheels is subsequently effected again, the clamping of the adjusting member automatically also takes place and is also electrically safeguarded.

In the arrangement according to the aforementioned German patent and allowed U.S. application, the clamping of the adjusting member which extends over the length of the gripper cylinder, is provided at only one location and is illustrated therein as being in the vicinity of the end of the cylinder on the drive side of the printing machine. No clamping is provided on the operator side of the printing machine, but rather the adjusting member is guided only between adjustable guide bars on the drive side and on the operator side. In order to permit axial movement of the adjusting member, a slight amount of play or clearance must exist between the adjusting member and the guide bars. The adjusting member is able to move within this play or clearance on the operator side of the printing machine while the machine is in operation, particularly at high machine speeds. These micromovements cause so-called "fit rust", i.e., abrasion with the formation of superfine dust, so that the adjusting member is no longer able to move freely on the gripper cylinder and can no longer be adjusted in a conventional manner.

It is accordingly an object of the invention to provide a clamping device of the foregoing general type which prevents such micro-movements and, thus, the generation of fit rust.

With the foregoing and other objects in view, there is provided, in accordance with the invention, in a sheet-fed rotary printing machine having a sheet-turning device including a gripper cylinder and an adjusting member extending in axial direction of and axially displaceable on the gripper cylinder for changing-over a gripper on the gripping cylinder, a clamping device for the adjusting member, comprising preloaded spring means, clamping members disposed on both sides of and in vicinity of axial ends of the adjusting member and being displaceable radially to the gripper cylinder, and a pressure bar axially movably guided in the gripper cylinder and biased by a reaction force of the spring means in a clamping direction for firmly clamping the clamping members via respective intermediate elements radially towards the gripper cylinder.

Consequently, the adjusting member, which extends axially on the gripper cylinder, is held by clamping on the gripper cylinder not only on the drive side of the printing machine but also on the operator side thereof, thus at least at two locations, in order in this manner to prevent micromovements, which tend toward the generation of fit rust.

In accordance with another feature of the invention, the intermediate elements include a double-armed pressure lever, a bearing pin mounted in the gripper cylinder and articulatingly supporting the double-armed lever, the bearing pin extending transversely to a longitudinal axis of the gripper cylinder, the double-armed pressure lever having one arm thereof forming a counter-bearing for the pressure bar, and the other arm thereof forming a support for at least one of the clamping members, the support being movable radially in the gripper cylinder, the at least one clamping member being located at a drive side of the printing machine and being movable in the adjusting member radially to the longitudinal axis of the gripper cylinder, the bearing pin of the pressure lever being formed as a rolling pin and being movable in the gripper cylinder axially to the longitudinal axis of the gripper cylinder and rotatably connected to a pressure member movable in axial direction in the gripper cylinder and operatively engageable with another pressure lever, a hinge pin fixed to the gripper cylinder, the other pressure lever being turnably mounted on the hinge pin at an operating side of the printing machine and forming a counter-bearing for the pressure member and, at an angle, thereto, forming a support for others of the clamping members, the others of the clamping members being guidable in the adjusting member on the operator side of the printing machine radially to the longitudinal axis of the gripper cylinder.

In such an embodiment, the reaction force of the spring which effects the clamping between the fixed gearwheel and the adjustable gearwheel is transmitted simultaneously to a plurality of clamping members which are disposed at spaced intervals from one another in the direction of the longitudinal axis of the gripper cylinder, so that the clamping of the axially movable adjusting member to the gripper cylinder is effected at a plurality of locations simultaneously with the clamping of the drive gearwheels.

In accordance with a further feature of the invention, the pressure member is formed with a bifurcation at an end thereof facing towards the drive side of the printing machine, the bifurcation partly embracing the double-armed pressure lever and formed with bearing eyes for receiving the ends of the rolling pin therein.

In accordance with an additional feature of the invention, there are provided rolling plates fastened to the gripper cylinder, the rolling pin being supported in the gripper cylinder on the rolling plates.

In accordance with a concomitant feature of the invention, the clamping members are movable radially to the longitudinal axis of the gripper cylinder, a clamp strap disposed in the gripper cylinder at the operator side of the printing machine, the others of the clamping members being connected via tension bolts to the clamp strap, the clamp strap being formed with a wedge surface disposed at an angle to the axial direction of movement of the pressure member and cooperatively engageable with a wedge surface formed on the pressure member.

Other features which are considered as characteristic for the invention are set forth in the appended claims.

Although the invention is illustrated and described herein as embodied in a CLAMPING DEVICE FOR AN AXIALLY DISPLACEABLE ADJUSTING MEMBER FOR CHANGING-OVER A GRIPPER ON A GRIPPER CYLINDER OF A SHEET-FED ROTARY PRINTING MACHINE, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIGS. 1*a* and 1*b* are vertical sectional views in an axial plane of drive-side and operator-side parts, respectively, of a gripper cylinder of a turning device in a force or friction-locked clamped state;

FIG. 2*a* is a sectional view of FIG. 1*a* taken along the line IIa—IIa in the direction of the arrows;

FIG. 2*b* is a sectional view of FIG. 1*b* taken along the line IIb—IIb in the direction of the arrows;

Figure 1A:
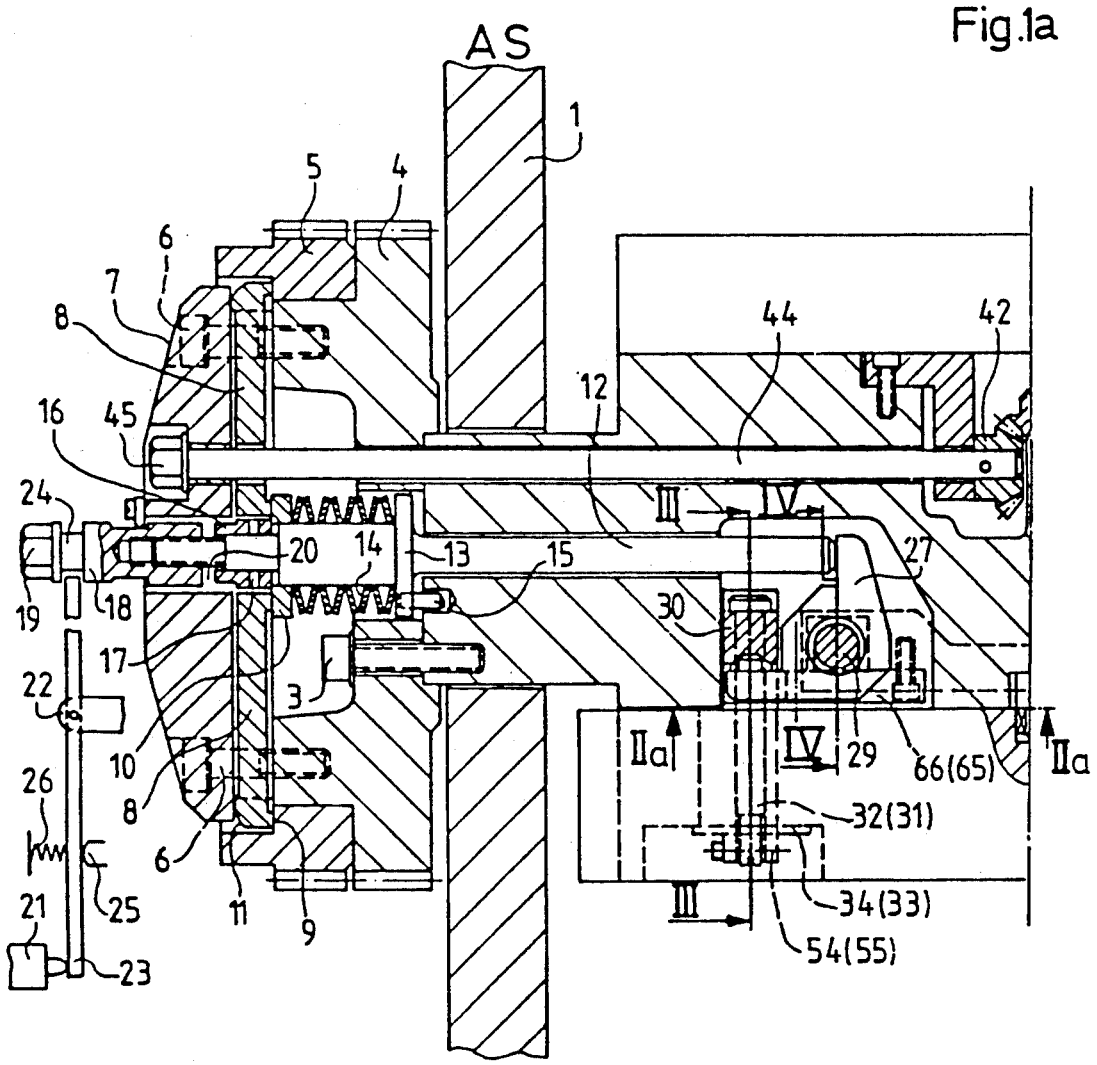
Figure 1B:
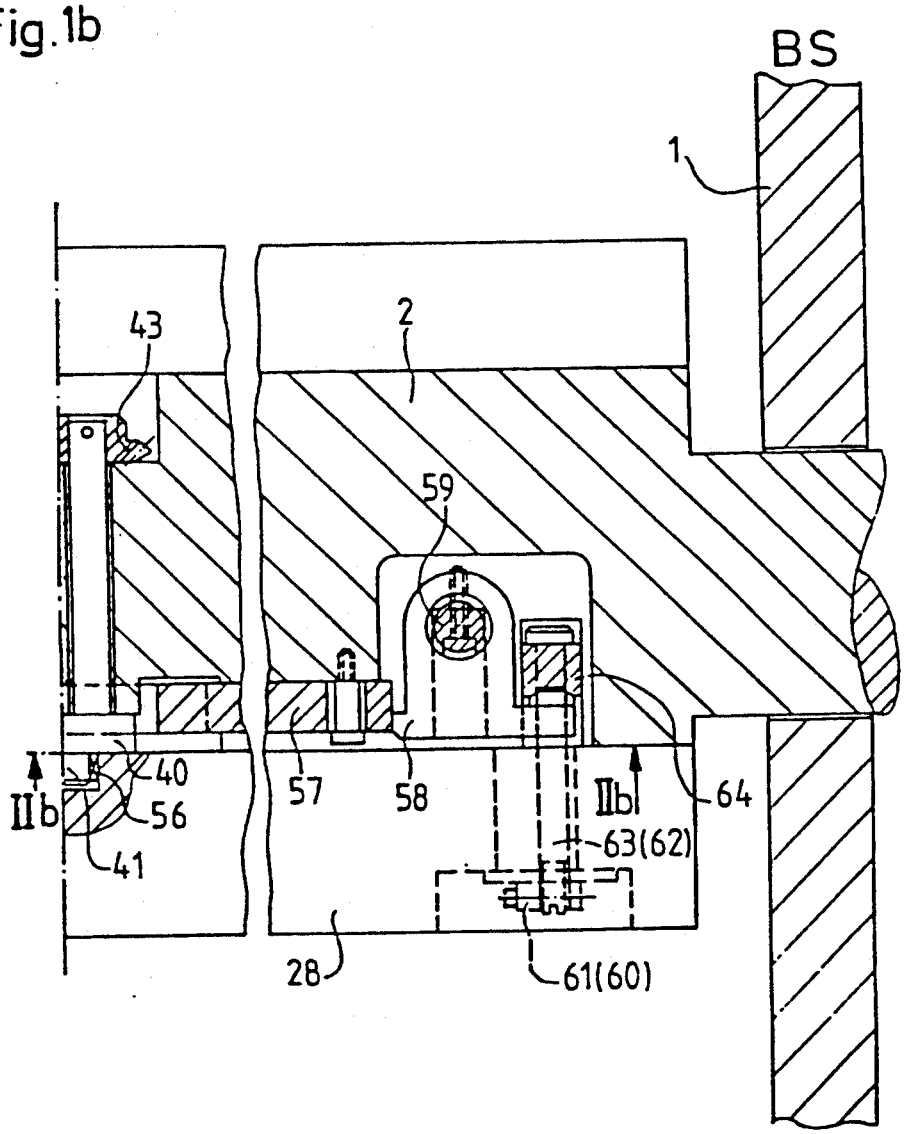

Referring now to the drawings and, first, particularly to FIGS. 1*a* and 1*b* thereof, there is shown therein a gripper cylinder 2 supported in a printing machine frame 1, permanently connected on a drive side AS of the printing machine outside the machine frame 1 by bolts 3 to a fixed gearwheel 4, which has a socket or collar projection on which is disposed a crown-like adjusting gearwheel 5, which is adjustable in rotational angle with respect to the fixed gearwheel 4. For the purpose of force or friction-locked clamping of both gearwheels 4 and 5, a support plate 7 is fastened to an end face of the collar projection of the fixed gearwheel 4 by means of bolts 6. A plurality of radially directed and circumferentially uniformly distributed pressure levers 8 are braced against the support plate 7. One end of the pressure levers 8 acts against an annular surface 9 on the adjusting gearwheel 5 and the other end lies against a disc 10 acting as a spring-loaded pressure member. The pressure levers 8 are braced, at the rear side thereof, against the support plate 7 by cams 11 which are disposed in the vicinity of the outer ends of the pressure levers 8. The disc 10 is axially movably guided on a pressure bar 12 which, in turn, is axially movably guided in the gripper cylinder 2 parallel to the axis of the latter and is formed with a radial flange 13, against which a spring 14 is braced at one end thereof, and acts against the disc 10 at the other end thereof. The spring 14 in the illustrated construction is formed of alternatingly arranged cup springs, which are preloaded and exert force upon the pressure levers 8 at the inner ends thereof and, thus, at the end of the long lever arms thereof. Respective ends of a pin 15 shown in FIG. 1*a* engage in bores formed in the radial flange 13 and in the gripper cylinder 2, so that the pressure bar 12 is secured against turning.

On a side opposite the spring 14, a pressure ring 16, through which the pressure bar 12 extends, acts with an integrated roller bearing 17 against the disc 10. A threaded sleeve 18 which is screwable on a thread of the pressure bar 12 and is able to be threadedly secured by an operating element, for example a hexagon head 19, is movable against the other end of the roller bearing 17. Play or clearance 20 between the threaded sleeve 18 and the pressure ring 16 permits the release of the clamped connection between the fixed gearwheel 4 and the adjusting gearwheel 5 only if an electrical safety device has been actuated, so that, only thereafter, by movement of the threaded sleeve 18, can forces act upon the pressure ring 16 in order to reduce the reaction force exerted on the pressure levers 8 by the preloading of the spring 14. Within the play or clearance space 20, the threaded sleeve 18 actuates a switch 21 through the intermediary of a double lever 23, which is pivotally secured to the printing machine at 22. One end of the double lever 23 engages in an annular groove formed on the circumference of the threaded sleeve 18, and the other end thereof acts upon an operating element of the switch 21. This other lever end extends between a stop 25 and a spring 26. The spring 26 ensures the return of the double lever 23 to the stop position thereof, in which the switch 21 enables or releases the electrical circuit of the printing machine when the gearwheels 4 and 5 have been clamped. Consequently, if the threaded sleeve 18 is screwed towards the right-hand side within the clearance space 20, as viewed in FIG. 1*a*, the switch 21 for interrupting the electrical circuit to the drive of the printing machine is initially actuated, before the pressure ring 16 for reducing the action of the reaction force of the spring 14 on the ends of the pressure levers 8 is shifted axially against the disc 10. To limit this movement, the pressure ring 16 is disposed on a step portion of the pressure bar 12 which has a smaller diameter than the part extending through the spring 14, so that a step-shaped stop is formed for the movement of the pressure ring 16.

Figure 2A:
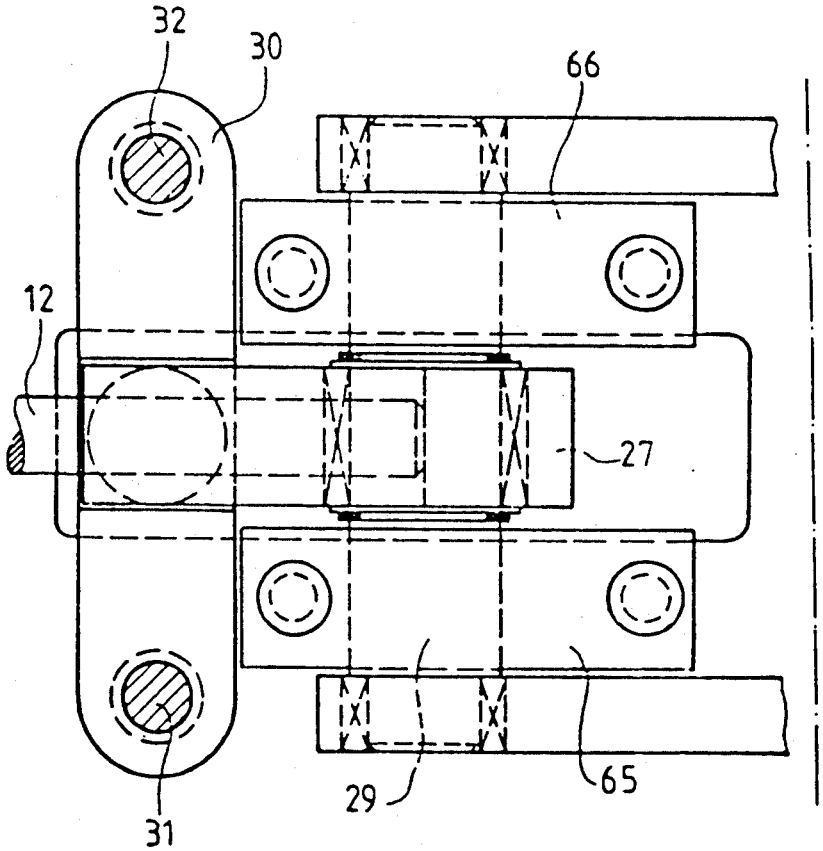

The other end of the pressure bar 12 acts against an arm of an angle-shaped pressure lever 27 which, in the gripper cylinder 2, in the vicinity of an adjusting member 28, which is axially movable with respect to the gripper cylinder 2, is movable about a bearing pin 29 disposed transversely to the longitudinal axis of the gripper cylinder 2. The other arm of the pressure lever 27 engages underneath a clamp 30 having ends (note FIG. 2*a*) which are respectively connected by tension bolts 31 and 32 to clamping members 54 and 55 which are disposed in recesses of the adjusting member 28 and act against the ends of the clamp strap 30 through the intermediary of washers 33 and 34. The tension bolts 31 and 32 have collar-type heads by which they engage behind the clamp strap 30 and are guided by bores formed in the clamp strap 30 and in the adjusting member 28. Through the intermediary of the pressure lever 27, the pressure bar 12 transmits the reaction force of the spring 14 to the clamp straps 30, so that the reaction force acts, via the tension bolts 31 and 32, as a clamping force upon the clamping members 54 and 55 and presses the adjusting member 28 against seating surfaces which are formed on the circumference of the gripper cylinder 2. Due to the spherical shape of the contact surfaces of the pressure lever 27 and of the clamp strap 30, uniform clamping forces are attained at both clamping members 54 and 55, it being possible, if necessary or desirable, for the contact surface to be formed on thrust washers made from a wear-resistant material. The clamping members 54 and 55 are screwable onto the free ends of the tension bolts 31 and 32, so that an adjustment of the clamping forces and of a play or clearance between the pressure bar 12 and the transmission members is possible, and the adjusting member 28 can be axially adjusted if the spring 14 for reducing the reaction forces from the preloading of the spring, which acts upon the pressure levers 8, is compressed, the pressure bar 12 being moved to the left-hand side in FIG. 1*a* of the drawing until the pressure ring 16 contacts the stop shoulder of the pressure bar 12.

Figure 2B:
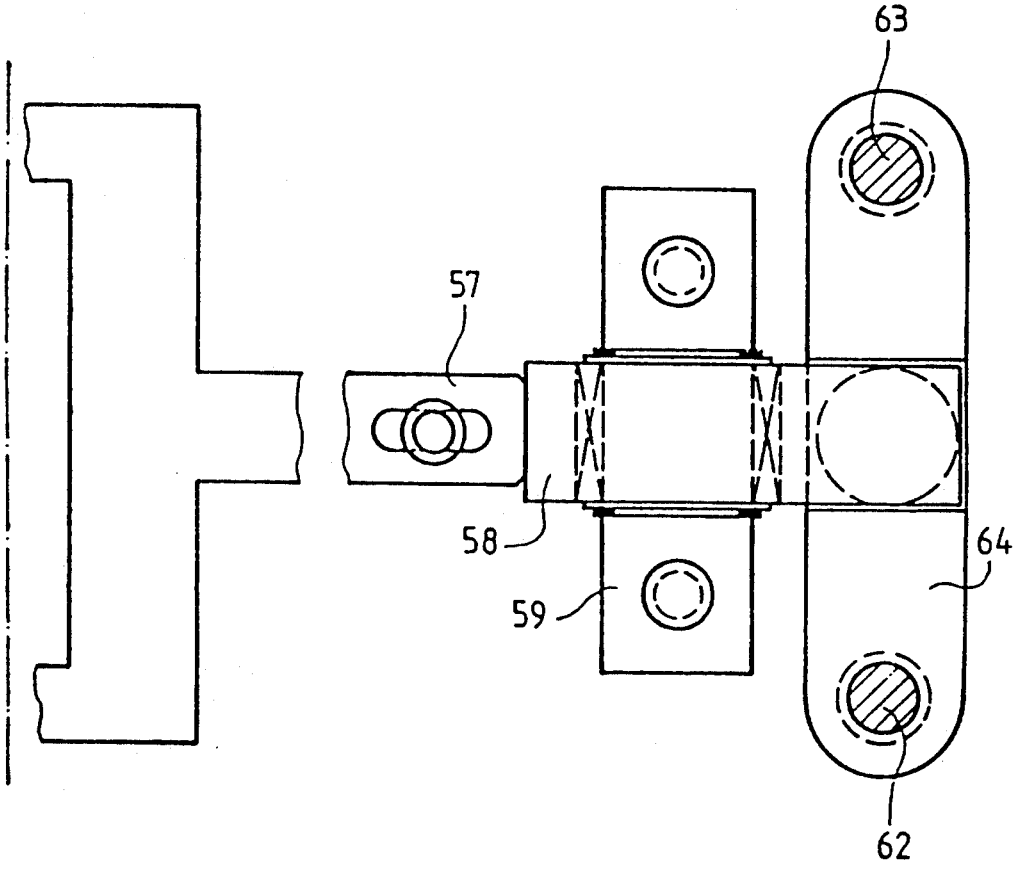
Figure 3:
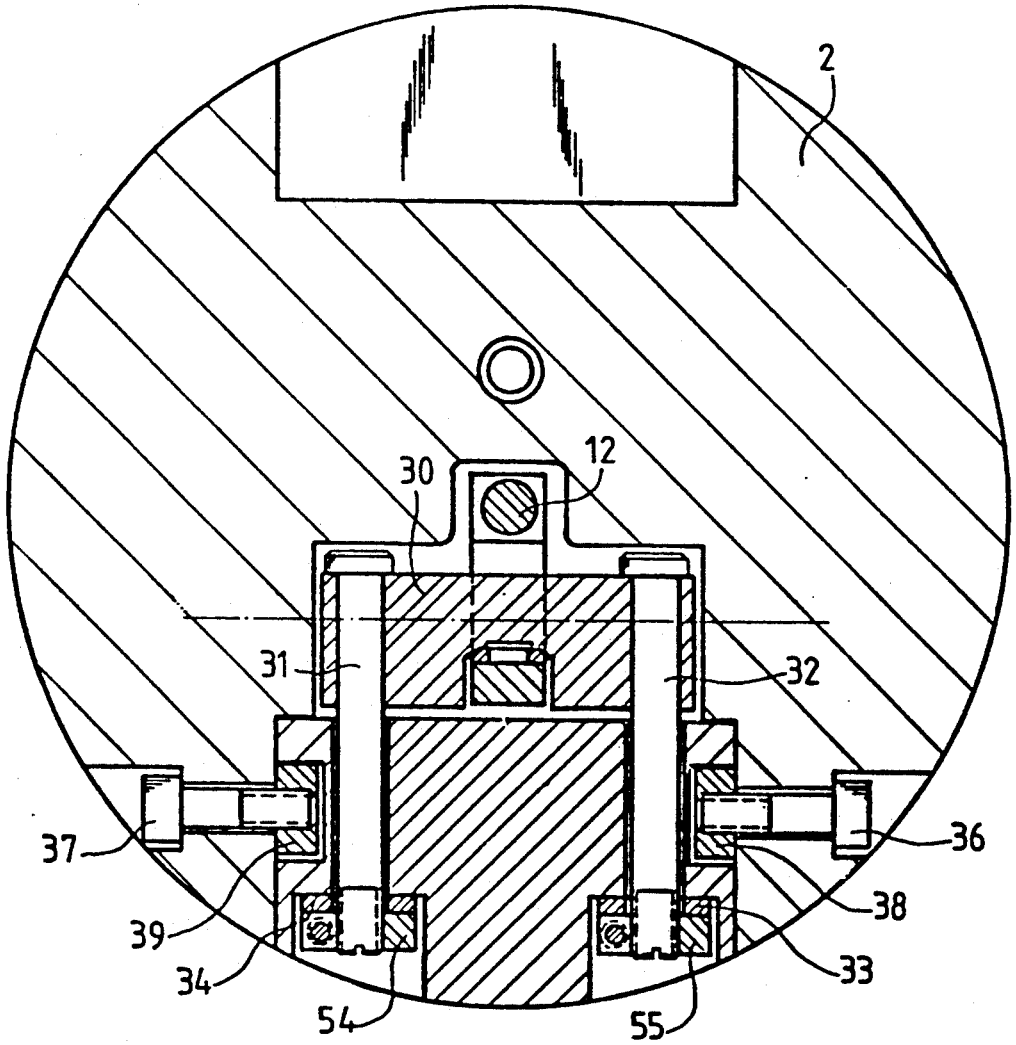
FIG. 3 is a sectional view of FIG. 1*a* taken along the line III—III in the direction of the arrows.
Figure 4:
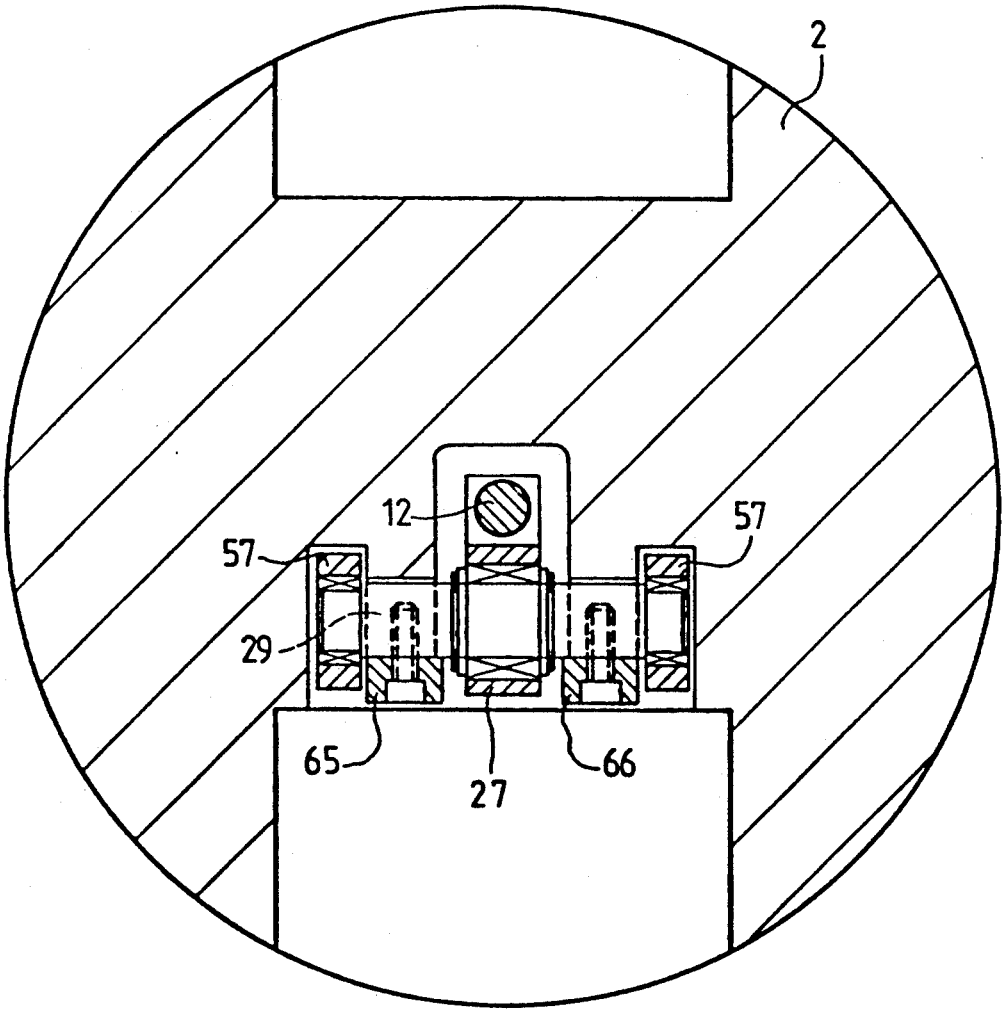
FIG. 4 is a sectional view of FIG. 1*a* taken along the line IV—IV in the direction of the arrows.

Because the axially movable adjusting member 28 for the gripper changeover is in the form of a slide extending over the width of the printing machine and is guided, both on the drive side AS as well as on the operator side BS, in a recess of the gripper cylinder 2 at guide bars 38 and 39 which are adjustable by bolts 36 and 37, the adjusting member 28 also is to be clamped at least at two locations advantageously on the drive side AS and on the operator side BS. To achieve this aim, the bearing pin 29 of the angle-shaped pressure lever 27 is in the form of a rolling pin and is supported in the gripper cylinder so as to be movable axially with respect to the longitudinal axis of the latter. Furthermore, the rolling pin 29 is connected in a rotationally movable manner to a pressure member 57, which is axially displaceable in the gripper cylinder 2 and which acts upon a further pressure lever 58, which is mounted so as to be movable about a fixed transverse axis, on a hinge pin 59 on the operator side BS in the gripper cylinder 2. This pressure lever 58, too, has a counter-bearing for the end of the pressure member 57 facing towards it and, at an angle thereto, has a support for the clamping members 60, 61, which is radially movably guided on the operator side BS with respect to the longitudinal axis of the gripper cylinder 2 in the adjusting member 28 and is connected, in conformity with the shape on the drive side AS, by means of tension bolts 62 and 63 to a clamp strap 64, which is engaged from below by the angularly offset support of the pressure lever 58. The pressure member 57 is in the form of a fork or bifurcation at the drive-side end, so that it partly surrounds or embraces the pressure lever 27 with the fork-shaped portion thereof. Bearing eyes for mounting the ends of the rolling pin 29 are disposed in the free leg or tine ends of the fork. The foregoing construction is readily apparent from FIGS. 2*a* and 2*b*. As a support or bracing for the rolling pin 29, rolling plates 65 and 66 of a hardenable material are provided, on both sides of and adjacent to the pressure lever 27 in the gripper cylinder 2, and the rolling pin 29 is able to roll thereon in the direction of the longitudinal axis of the gripper cylinder 2.

The reaction forces of the spring 14 effecting the clamping of the axial adjusting member 28 are transmitted from the pressure bar 12, on the one hand, to the pressure lever 27 and from the latter to the clamping members 54 and 55 provided on the drive side AS and, simultaneously, through the intermediary of the rolling pin 29 and the fork-shaped pressure member 57, to the pressure lever 58 and thus also to the clamping members 60 and 61 on the operator side BS, with the rolling pin rolling minimally on the rolling plates 65 and 66 as a function of the adjustment travel.

An eccentric mechanism made up of an eccentric pin 40 and an eccentric bolt 41 engaging a bearing 56 of the adjusting member 28 serves for the axial adjustment of the adjusting member 28 for the gripper changeover. The adjustment of the eccentric pin 40 is accomplished in the illustrated embodiment by a right-angle drive formed of bevel gearwheels 42 and 43 and a switching shaft 44 which is rotatably supported in the gripper cylinder 2. The outer end of the switching shaft 44 extends out of the support plate 7 and has an actuating element, for example a hexagon head 45, for a socket wrench. The actuation of the hexagon head 45 may be included in the electrical safety system in a conventional manner.

Figure 5:
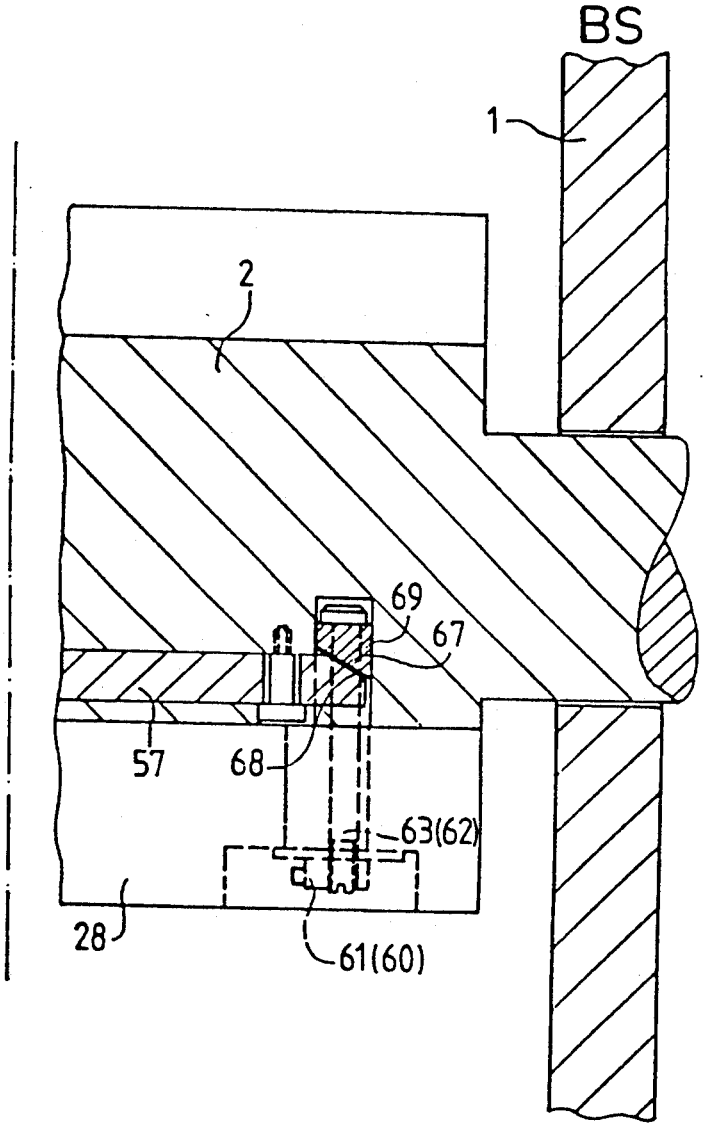
FIG. 5 is a vertical sectional view in an axial plane, like the view of FIG. 1*b*, of another embodiment of a device for clamping the adjusting member on the operator side, in accordance with the invention.

Differing from the embodiment described hereinbefore, the embodiment of FIG. 5 has one or more clamping members 60, 61, which are radially movable with respect to the longitudinal axis of the gripper cylinder 2, and are connected on the operator side via tension bolts 62, 63 to a clamp strap 69, which has a wedge surface 67 disposed at an angle to the direction of movement of the pressure member 57 and cooperating with a wedge surface 68, which is formed directly on the pressure member 57.

I claim:

1. In a sheet-fed rotary printing machine having a sheet-turning device including a gripper cylinder and an adjusting member extending in axial direction of and axially displaceable on the gripper cylinder for changing-over a gripper on the gripping cylinder, the adjusting member having opposite sides and respective axial ends, a clamping device for the adjusting member, comprising preloaded spring means, clamping members disposed on both of the sides of an in vicinity of the axial ends of the adjusting member and being displaceable radially to the griper cylinder, and a pressure bar axially movably guided in the gripper cylinder and biased by a reaction force of said spring means in a given direction for firmly clamping said clamping members radially towards the gripper cylinder.

2. Clamping device according to claim 1, including elements intermediate said spring means and said clamping members comprising a double-armed pressure lever, a bearing pin mounted in the gripper cylinder and supporting said double-armed lever, said bearing pin extending transversely to a longitudinal axis of the gripper cylinder, said double-armed pressure lever having one arm thereof forming a counter-bearing for said pressure bar, and the other arm thereof forming a support for at least one of said clamping members, said support being movable radially in the gripper cylinder, said at least one clamping member being movable in the adjusting member radially to the longitudinal axis of the gripper cylinder, a pressure member movable in axial direction in the gripper cylinder, said bearing pin of said pressure lever being formed as a rolling pin rotatably connected to said pressure member and being movable in the gripper cylinder axially to the longitudinal axis of the gripper cylinder, a hinge pin fixed to the gripper cylinder, another pressure lever being turnably mounted on said hinge pin at an operating side of the printing machine and forming a counter-bearing for said pressure member and at an angle, thereto, forming a support for at least another of said clamping members, said at least another of said clamping members being guidable in the adjusting member radially to the longitudinal axis of the gripper cylinder.

3. Clamping device according to claim 2, wherein said pressure member is formed with a bifurcation at an end thereof, said bifurcation partly embracing said double-armed pressure lever and formed with bearing eyes for receiving the ends of said rolling pin therein.

4. Clamping device according to claim 2, including rolling plates fastened to the gripper cylinder, said rolling pin being supported in the gripper cylinder on said rolling plates.

5. Clamping device according to claim 2, wherein said at least another of said clamping members is movable radially to the longitudinal axis of the gripper cylinder, a clamp strap disposed in the gripper cylinder, said at least another of said clamping members being connected via tension bolts to said clamp strap, said clamp strap being formed with a first wedge surface diposed at an angle to the axial direction of movement of said pressure member, said pressure member being formed with a second wedge surface cooperatively engageable by said first wedge surface.

* * * * *